US010319242B2

(12) United States Patent
Sindlinger et al.

(10) Patent No.: US 10,319,242 B2
(45) Date of Patent: Jun. 11, 2019

(54) MANEUVER PREDICTION FOR SURROUNDING TRAFFIC

(71) Applicant: The Boeing Company, Chicago, IL (US)

(72) Inventors: Andreas Sindlinger, Wintergrasse (DE); Garoe Gonzalez Parra, Frankfurt am Main (DE); Jonas Michael Schulze, Darmstadt (DE)

(73) Assignee: THE BOEING COMPANY, Chicago, IL (US)

( * ) Notice: Subject to any disclaimer, the term of this patent is extended or adjusted under 35 U.S.C. 154(b) by 137 days.

(21) Appl. No.: 15/351,826

(22) Filed: Nov. 15, 2016

(65) Prior Publication Data

US 2018/0137765 A1 May 17, 2018

(51) Int. Cl.
*G08G 5/00* (2006.01)
*G08G 5/04* (2006.01)

(52) U.S. Cl.
CPC ..... *G08G 5/0039* (2013.01); *G08G 5/0004* (2013.01); *G08G 5/0021* (2013.01); *G08G 5/0034* (2013.01); *G08G 5/0052* (2013.01); *G08G 5/0078* (2013.01); *G08G 5/045* (2013.01)

(58) Field of Classification Search
CPC combination set(s) only.
See application file for complete search history.

(56) References Cited

U.S. PATENT DOCUMENTS 6,201,482 B1 * 3/2001 Schiefele ..... G08G 5/006 340/961
7,623,957 B2 11/2009 Bui et al.
9,087,452 B2 7/2015 del Pozo de Poza et al.
9,250,099 B2 2/2016 Felix et al.
2002/0133294 A1 * 9/2002 Farmakis ..... B60R 25/102 701/301
2013/0338910 A1 * 12/2013 Vilaplana ..... G06Q 10/047 701/122
2016/0117936 A1 * 4/2016 Klinger ..... G08G 1/162 701/3

OTHER PUBLICATIONS

Extended European Search Report dated Apr. 20, 2018 from corresponding European Application No. 17201471.4.

* cited by examiner

*Primary Examiner* — Anne M Antonucci
*Assistant Examiner* — Renee LaRose
(74) *Attorney, Agent, or Firm* — MH2 Technology Law Group LLP

(57) ABSTRACT

This disclosure relates to navigating a vehicle based on predicted trajectories of other vehicles. Systems, methods, and computer-program products consistent with the disclosure perform operations including receiving location information of other vehicles. The operations also include comparing the location information of the other vehicles with an intended trajectory information of the vehicle. The operations further include determining that interference exists based on the comparing. Additionally, the operations include determining a modification to the intended trajectory information of the vehicle that resolves the interference with one of the other vehicles. Moreover, the operations include presenting the modification to the intended trajectory information of the vehicle to an operator of the vehicle. Further, the operations include modifying the intended trajectory using the modification.

25 Claims, 5 Drawing Sheets

MANEUVER PREDICTION FOR SURROUNDING TRAFFIC

FIELD

This disclosure relates to systems and methods for vehicle navigation. In particular, the present disclosure is concerned with navigating a vehicle based on predicted trajectories of other vehicles.

BACKGROUND

Vehicles operating in traffic may have different capabilities and, accordingly, operate at different speeds and/or travel in different corridors. For example, some aircraft within an airspace may operate at lower speeds and altitudes than others. As a result, an aircraft capable of operating efficiently at high speeds may be forced to fly at a suboptimal speed to accommodate slower traffic occupying the same flight corridor. The planned arrival time of the aircraft at its destination may, therefore, be delayed and the aircraft may burn more fuel than it would have otherwise. In another situation, an air traffic controller may require the aircraft to increase its altitude to avoid any interference with the slower aircraft. However, such unplanned maneuvers may burn more fuel than a preplanned change in trajectory performed to occupy a more efficient cruising altitude or to maneuver at a more efficient rate.

In situations such as those above, an operator of the vehicle can attempt to make a maneuver that mitigates the interference of the slower traffic. However, existing navigations systems may not offer sufficient information of other traffic for the operator to plan and implement such a maneuver. For example, when deciding whether to change trajectory, an aircraft pilot may only have access to limited traffic information from radio communication or traffic collision avoidance system ("TCAS") advisories. By relying on such limited traffic information, the pilot may make a maneuver that is more costly (i.e., less efficient) than its alternatives. Moreover, because the pilot must take the effort to obtain and analyze the available traffic information, the pilot may be unable to make a timely request for a change in trajectory from an air traffic controller.

SUMMARY

This disclosure relates to navigating a vehicle based on predicted trajectories of other vehicles. Systems, methods, and computer-program products consistent with the disclosure perform operations including receiving location information of other vehicles. The operations also include comparing the location information of the other vehicles with an intended trajectory information of the vehicle. The operations further include determining that interference exists based on the comparing. Additionally, the operations include determining a modification to the intended trajectory information of the vehicle that resolves the interference with one of the other vehicles. Moreover, the operations include presenting the modification to the intended trajectory information of the vehicle to an operator of the vehicle. Further, the operations include modifying the intended trajectory using the modification.

The features, functions, and advantages that have been discussed can be achieved independently in various embodiments or may be combined in yet other embodiments further details of which can be seen with reference to the following description and drawings.

BRIEF DESCRIPTION OF THE DRAWINGS

The accompanying drawings, which are incorporated in and constitute a part of this specification, illustrate the present teachings and together with the description, serve to explain the principles of the disclosure.

It should be noted that some details of the figures have been simplified and are drawn to facilitate understanding of the present teachings, rather than to maintain strict structural accuracy, detail, and scale.

DETAILED DESCRIPTION

This disclosure relates to systems and methods for vehicle navigation. In particular, the present disclosure is directed to navigating a vehicle based on predicted trajectories (e.g., position, direction or travel, and/or acceleration) of other vehicles. Methods and systems in accordance with aspects of the present disclosure can predetermine a modification to a trajectory (e.g., a change in a planned speed, direction, and/or altitude) of the vehicle that eliminates interference with a predicted trajectory of another vehicle. As used herein, interference refers to a condition in which the predicted path of at least one vehicle traveling potentially affects (e.g., slows or modifies) the planned trajectory of another vehicle. However, in the context of this application, interference does not include determining imminent physical collisions between vehicles. Further, the methods and systems can present the modification to an operator of the vehicle along with information that assists the operator in choosing whether to accept such modification. In implementations, the modification includes a maneuver (e.g., a, turn, a decent, or a climb) that minimizes a possibility that transit of the vehicle through a particular path (e.g., a predefined travel corridor) followed by the vehicle will be delayed and/or blocked by the other vehicle (e.g., a slower aircraft), for example, the methods and systems can predict whether a flight plan of an aircraft interferes with the other aircraft and determine a change of the flight plan (e.g., an early step climb) that avoids the interference. Implementations, the prediction can be based on Automatic Dependent Surveillance-Broadcast ("ADS-B") information of surrounding air traffic. Additionally, the prediction can be based on historical information (e.g., past performance of the other aircraft's routine flights). Further, the prediction can be based on environmental information obtained from sensors, such as wind, temperature, and air density. Further, in implementations, the modification is only proposed if it provides a sufficient benefit. For example, where the modification is for an aircraft to perform a step climb earlier than called for in the flight plan, the modification may only be presented to a pilot if the reduction in time, cost, and/or risk provide a sufficient cost benefit (e.g., greater than a threshold amount of time and/or fuel savings).

Figure 1:
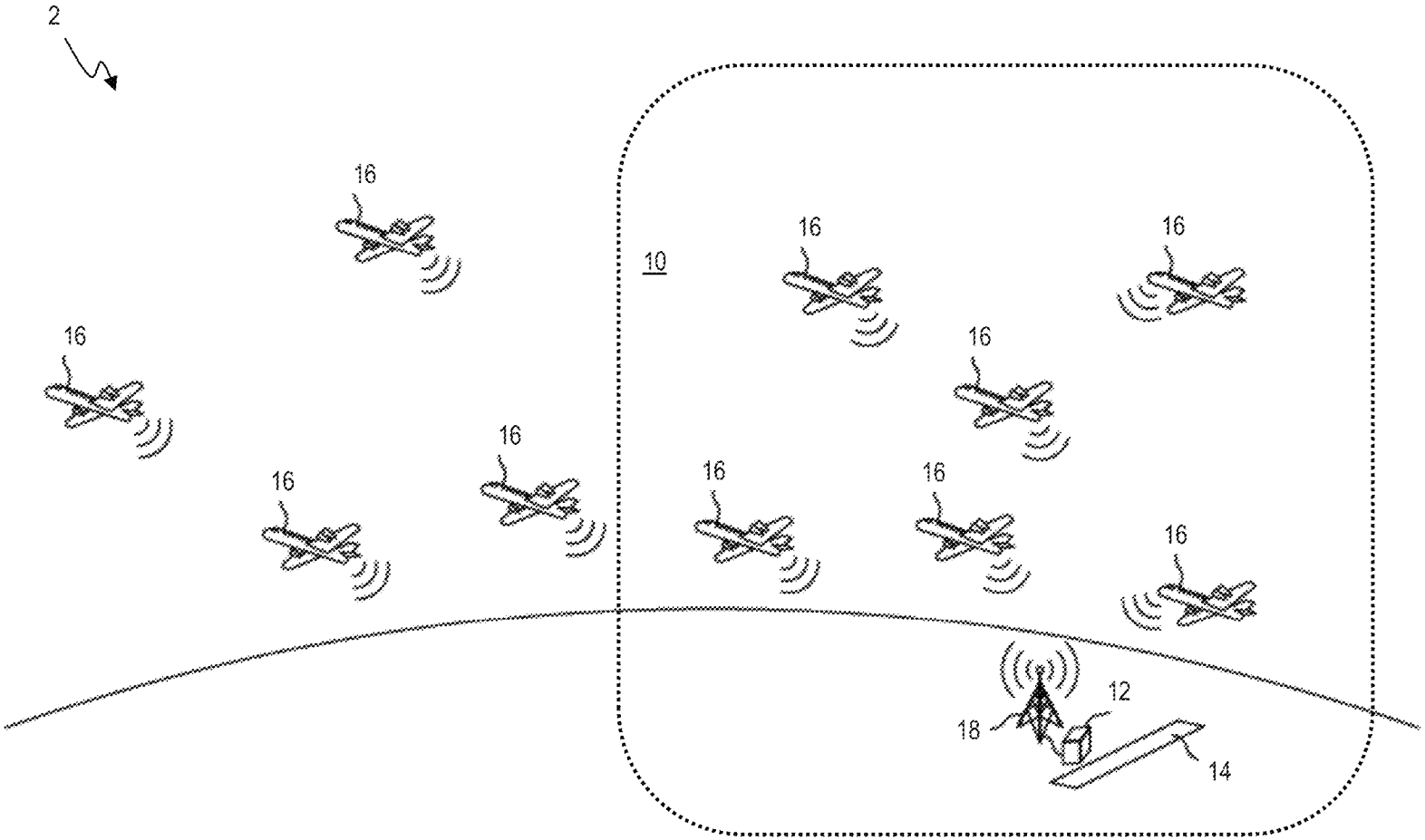
FIG. 1 illustrates an example of an environment for implementing systems and processes in accordance an embodiment of the present disclosure.

FIG. 1 is an example of an environment 2 for implementing methods and systems in accordance with aspects of the disclosure. The environment 2 includes airspace 10, an air traffic management facility 12, and an airport 14. The airspace 10 can include a region through which a number of aircraft 16 pass under control of the air traffic management facility 12. For example, the air traffic management facility 12 can be located at the airport 14 and be responsible for directing some or all of the aircraft 16 to maintain separation and/or flight corridors as they arrive and depart the airport 14, as well as when passing through the airspace 10. The air traffic management facility 12 includes a communication system 18 that allows two-way communication with the aircraft 16. Each of the aircraft 16 can be equipped with communication equipment (not shown in FIG. 1), such as a radio and/or a data link (e.g., ADS-B).

While environment 2 is illustrated using air travel, it is understood that implementations consistent with the present disclosure can be applied to terrestrial vehicles. For example, the vehicles can be fully-autonomous or semi-autonomous automobiles, trucks, and the like controlled by a central or distributed management system to maintain separation and travel lanes while traveling on a road.

Figure 2:
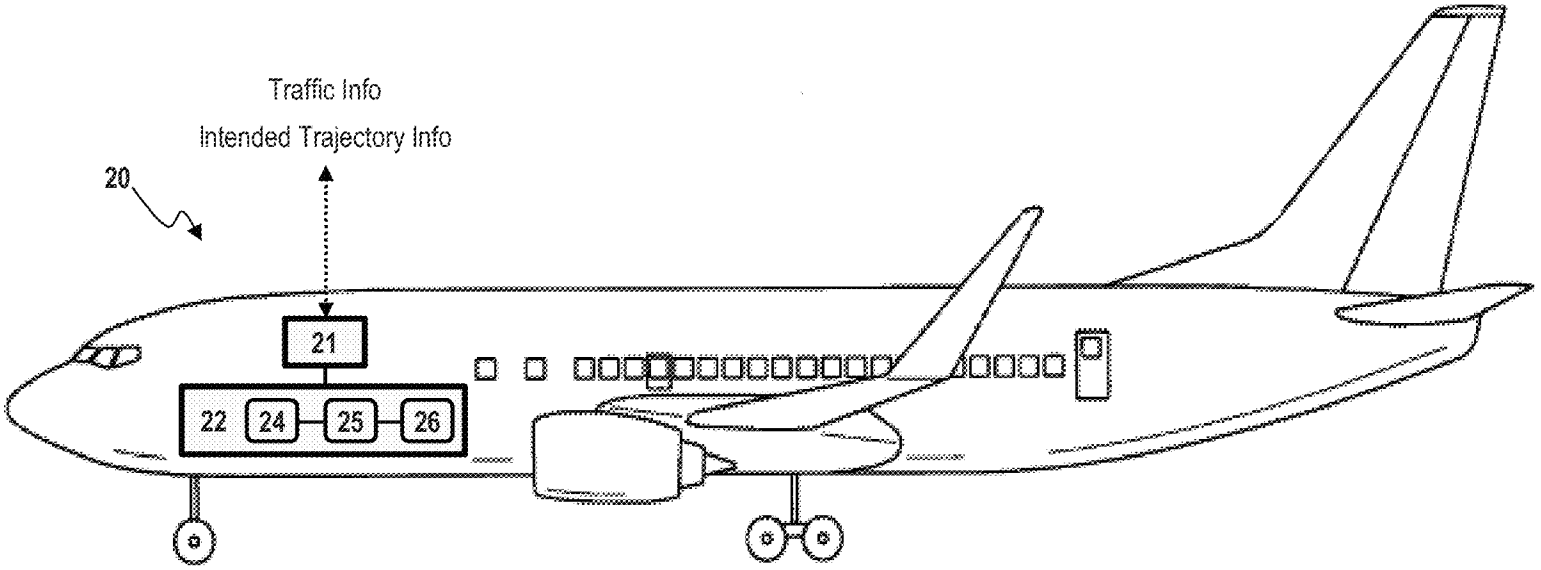
FIG. 2 illustrates an example of a vehicle in accordance with an embodiment of the present disclosure.

FIG. 2 illustrates an example of a vehicle 20 in accordance with aspects of the disclosure. In implementations, the vehicle 20 can be an aircraft, which may be the same or similar to those previously described (e.g., aircraft 16). In accordance with aspects of the present disclosure, the vehicle 20 includes a communication system 21 and a vehicle processing system 22. The communication system 21 can be one or more devices providing a radio and/or a data link for exchanging information between the vehicle 20 and other systems (e.g. aircraft 16 and/or air traffic management facility 12. In accordance with aspects of the present disclosure, the communication system 21 can send and/or receive traffic information and intended trajectory information. The traffic information can describe the current states of other vehicles. In implementations, the traffic information can include, for each vehicle, an identifier, a position, a velocity, an acceleration, a direction, one or more weather conditions, a fuel level, a weight and/or a center of gravity. The communication system 21 can receive such data at a real-time or a near real-time rate.

The intended trajectory information can include a preplanned path of a vehicle traveling from an origin location (e.g., airport 14) to a destination (e.g., a different airport similar to airport 14) during a particular trip. In implementations, the intended trajectory information can specify the origin location, the destination, a path, and rates of travel between the origin and the destination (e.g., latitudes, longitudes altitudes, and/or velocities) each portion of the path. For example, the intended trajectory information can be a flight plan for an aircraft determined by, for example, a pilot, a flight manager, and/or a flight planning software application. Additionally, the intended trajectory information can include physical information of the aircraft such as gross weight, fuel level, and center of gravity.

The vehicle processing system 22 can be one or more devices for monitoring and controlling the vehicle 20. In implementations, the vehicle processing system 22 can receive, process, store, distribute, and/or display information regarding the state of the vehicle 20 between a various systems and sensors of the vehicle 20. For example, the vehicle processing system 22 can be a flight management system that receives information from sensors monitoring the state of vehicle's drivetrain, and controls, processes such information, and drives displays for an operator of the vehicle 20. In accordance with aspects of the present of disclosure, the vehicle processing system 22 can include a navigation module 24, a path module 25, and an interference module 26. In some implementations, the navigation module 24, the path module 25, and/or the interference module 26 are components of the vehicle processing system 22. In other implementations, the navigation module 24, the path module 25, and/or the interference module 26 are physically separate units having respective computer processors communicatively coupled to the vehicle processing system 22 and to one another (e.g., avionics units communicating via a military standard-1553 (MIL-STD-1553) or an Aeronautical Radio, Incorporated (ARINC) data network).

The navigation module 24 can be hardware, software, or a combination thereof that determines the position and speed of the vehicle 20. The path module 25 can be hardware, software, or a combination thereof communicatively linked with the navigation module 24 and the interference module 26, that guides the vehicle along an intended trajectory, which can include the same information as previously described.

The interference module 26 can be hardware, software, or a combination thereof communicatively linked with the navigation module 24 and the path module 25 that predicts potential interferences with other vehicles, determines probabilities of such interferences, and determines recommendations for avoiding such interferences. In accordance with aspects of the present disclosure, the interference module 26 compares intended trajectory information of the vehicle 20 obtained from, e.g., the path module 25 with traffic data and intended trajectory information of other vehicles (e.g., aircraft 16) received via the communication system 21. Additionally, based on the comparison, the path module 25 can determine a modification of the intended trajectory information of the vehicle 20 to avoid interference with another vehicle. The modification of the intended trajectory information of the vehicle 20 can be provided to the path module 25 for presentation to the operator of the vehicle 20, along with details of the prediction, such as a probability of the predicted interference and a time frame for the predicted interference. For example, where vehicle 20 is an aircraft, the interference module 26 can predict trajectories of other aircraft based on location and flight plans obtained via an ADS-B data link, and compare the predicted trajectories to a planned flight path of the vehicle 20. Based on such comparison, the interference module 26 can recommend that the vehicle perform, e.g., a preplanned step climb to a particular flight level early to avoid interference from the other aircraft that is also predicted to use the same flight level. By doing so, the aircraft can be occupy that flight level before the other aircraft. For example, the pilot of the aircraft can request the flight level from air traffic control (air traffic management facility 12) and, if approved, control the aircraft to the corresponding altitude. Thus, the disclosed system supports the pilot by making recommendations of when to request a certain flight level. In implementations, the recommendations can be based on a balance of costs. For example, requesting a certain flight level earlier than expected can result in some cost penalty because the aircraft may too heavy for the particular level. However, such cost penalty might outweigh the costs of staying on the lower level (e.g. being too light or being obstructed by a slower aircraft). Additionally, the pilot can control the aircraft to climb at a gradual rate that is more efficient (in terms of fuel, time and/or risk) than would be required for an unplanned climb necessitated by the interference if such interference had not been predicted.

Figure 3:
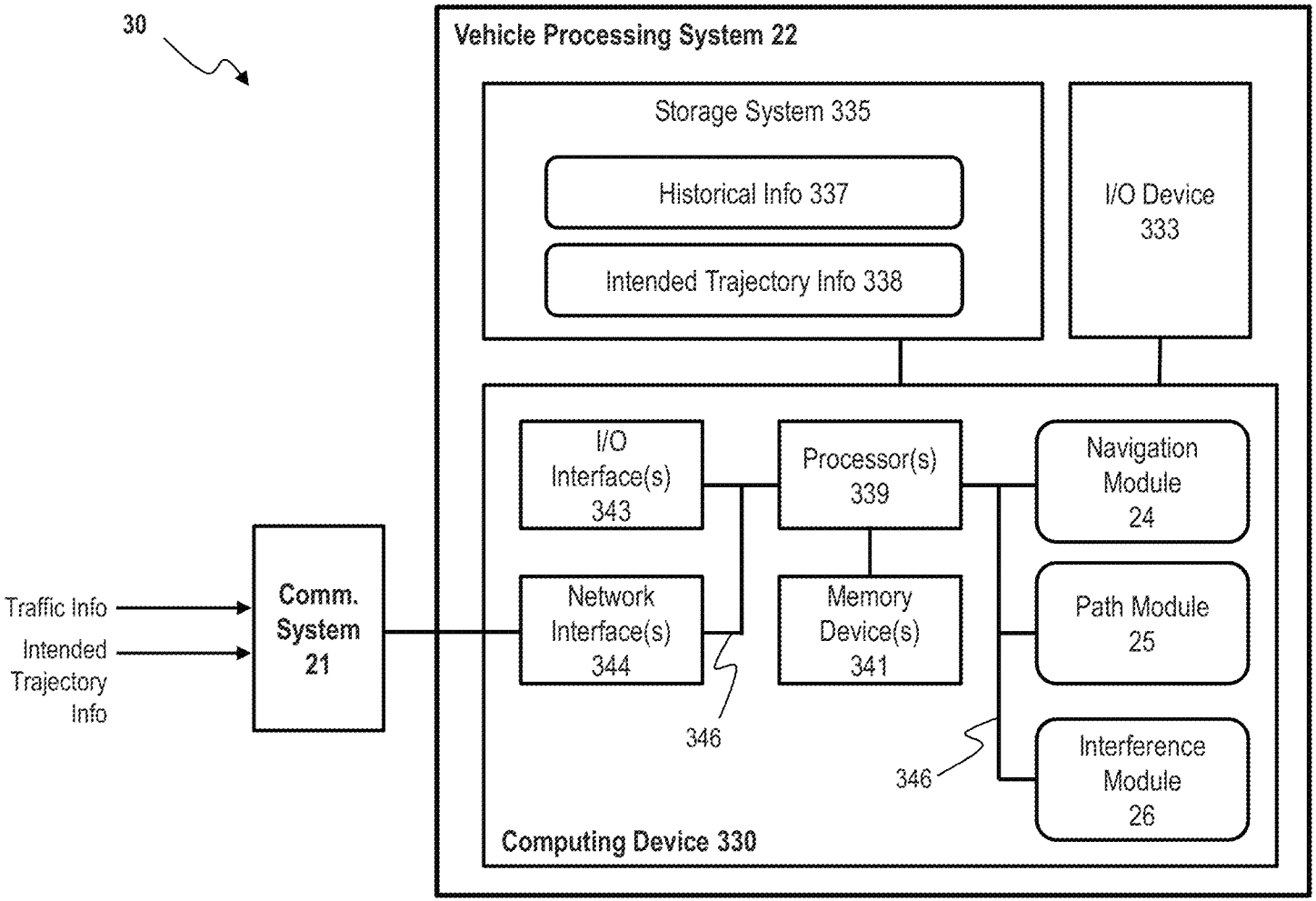
FIG. 3 illustrates a block diagram of a vehicle processing system in accordance with an embodiment of the disclosure.

FIG. 3 illustrates a block diagram of a system 30 in accordance with aspects of the disclosure. The system 30 includes a communication system 21, a vehicle processing system 22, a navigation module 24, a path module 25, and an interference module 26, all of which can be the same or similar to those described previously. In accordance with aspects of the disclosure, the system 30 includes hardware and software that perform processes and functions described herein. In particular, the vehicle processing system 22 includes a computing device 330, an input/output (I/O) device 333, and a storage system 335. The I/O device 333 can include any device that enables an individual (e.g., a pilot) to interact with the computing device 330 (e.g., a user interface) and/or any device that enables the computing device 330 present information to the individual. For example, I/O device 333 can be a display and keyboard of a Control Display Unit ("CDU") and/or an Engine Instrument Crew Alerting System ("EICAS").

The storage system 335 can comprise a computer-readable, non-volatile hardware storage device that stores information and computer program instructions. For example, the storage system 335 can be one or more flash drives and/or hard disk drives. Additionally, in accordance with aspects of the disclosure, the storage system 335 includes historical information 337 and intended trajectory information 338. The historical information 337 can be a collection of data about prior trips and/or past trajectories of vehicles (e.g., aircraft 16). In implementations, the historical information 337 can incorporate information obtained from previous flight plans and/or flight profiles of the other aircraft. For example, the historical information 337 can include information for a routine flight of an airline from a particular origin to a particular destination. The information can include the type of aircraft, flight plans of the aircraft, and the trajectory of the aircraft. Further, the historical information 337 can indicate maneuvers typically taken by the aircraft for the flight. For example, the historical data 337 can indicate locations and times during a routing flight at which an aircraft changes altitude (e.g., timing and position of descending and performing an approach). Further, the historical information 337 can indicate the state of the vehicle and its surroundings during the flight. For example, it can include aircraft type, configuration, weight, fuel load, and weather information. Intended trajectory information 338 can be the same or similar to that previously described. For example, the intended trajectory information 338 can includes information describing a particular trip taken by a vehicle including the system 30. In implementations, the intended trajectory information 338 is a flight plan of an aircraft.

In embodiments, the computing device 330 includes one or more processors 339, one or more memory devices 341 (e.g., RAM and ROM), one or more I/O interfaces 343, and one or more network interfaces 344. The memory device 341 can include a local memory (e.g., a random access memory and a cache memory) employed during execution of program instructions. Additionally, the computing device 330 includes at least one communication channel 346 (e.g., a data bus) by which it communicates with the I/O device 333, the storage system 335, the navigation module 24, the path module 25, and the interference module 26. The processor 339 executes computer program instructions (e.g., an operating system), which can be stored in the memory device 341 and/or storage system 335. Moreover, in accordance with aspects of the disclosure, the processor 339 can execute computer program instructions of the storage system 335, the navigation module 24, and the path module 25 to perform processes and functions described herein.

The vehicle processing system 22 can comprise any general purpose or special purpose computing article of manufacture capable of executing computer program instructions installed thereon (e.g., a personal computer, server, etc.). In implementations, the vehicle processing system 22 incorporates the functionality of existing flight management systems. However, it is understood that the vehicle processing system 22 is only representative of various possible equivalent-computing devices that can perform the processes described herein. To this extent, in embodiments, the functionality provided by the computing device 330 can be any combination of general and/or specific purpose hardware and/or computer program instructions. For example, the computing device 330 can be an off-the-shelf personal computer or a ruggedized flight mission computer. In each embodiment, the program instructions and hardware can be created using standard programming and engineering techniques, respectively.

Figure 4:
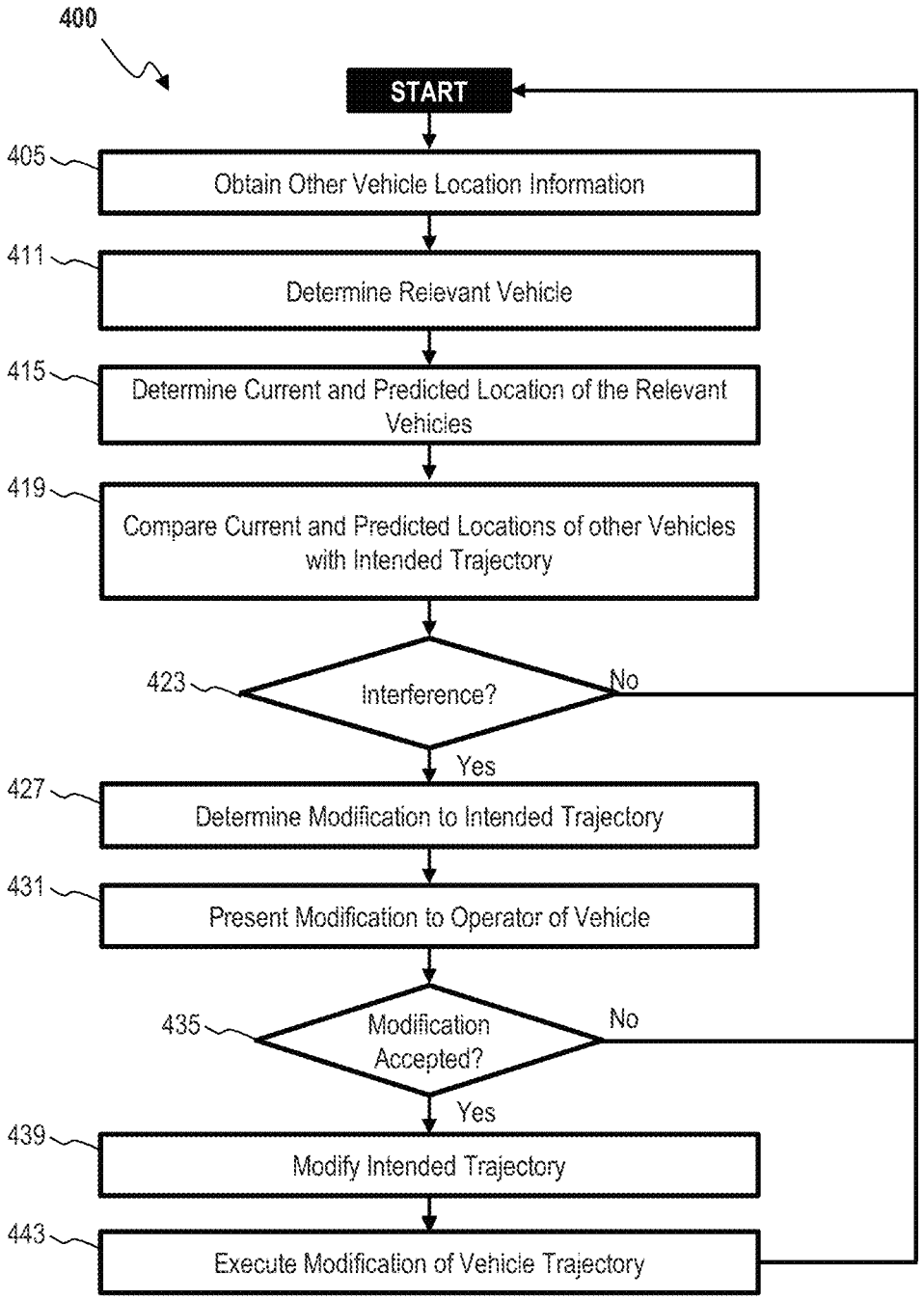
FIG. 4 illustrates a process flow diagram including operations performed in accordance an embodiment of the present disclosure.

The flowchart in FIG. 4 illustrates functionality and operation of possible implementations of systems, devices, methods, and computer program products according to various embodiments of the present disclosure. Each block in the flow diagram of FIG. 4 can represent a module, segment, or portion of program instructions, which includes one or more computer executable instructions for implementing the illustrated functions and operations. In some alternative implementations, the functions and/or operations illustrated in a particular block of the flow diagram can occur out of the order shown in FIG. 4. For example, two blocks shown in succession can be executed substantially concurrently, or the blocks can sometimes be executed in the reverse order, depending upon the functionality involved. It will also be noted that each block of the flow diagram and combinations of blocks in the block can be implemented by special purpose hardware-based systems that perform the specified functions or acts, or combinations of special purpose hardware and computer instructions.

FIG. 4 illustrates a flow diagram of an exemplary process 400 for predicting interference between a first vehicle and one or more other vehicles. Further, the process 400 can provide an operator with a choice of one or more maneuvers that mitigate the interference. In implementations the process 400 predicts aviation traffic along a trajectory of an aircraft and determines a change to an existing flight plan (e.g., an early climb) that can avoid the interfering traffic in a manner that saves fuel and/or time by, for example, by modifying the time and/or location of a preplanned maneuver (e.g., an early climb to a particular flight level).

At 405, the process 400 (executed, e.g., by vehicle processing system 22) obtains location information one or more other vehicles. The location information can be obtained by a communication system (e.g., communication system 21) via radio or data link transmissions. The location information can include traffic information and trip information, which can be the same or similar to those previously described. In some implementations, the information relates to a multitude of vehicles, such that the first vehicle can predict potential interferences with planned trajectories of any of the other vehicles.

At 411, the process 400 (using, e.g., interference module 26) determines one or more relevant vehicles from among the other vehicles based on the location information obtained at 405. In implementations, the determination of the relevant vehicles includes comparing the traffic information and/or the trip information of the one or more other vehicles to the trajectory (e.g., intended trajectory information 338) of the first vehicle and determining a probability that one of the other vehicles will interfere (e.g., obstruct in time and location). For example, the process 400 can determine that a particular one of the other vehicles is not relevant if there is no chance (0.0%) that its trajectory can intersect that of the first vehicle based on that particular vehicle's location, speed, and trajectory. In implementations, the relevance of another vehicle can also be determined using by historical data (e.g., historical data 337), such as past ADS-B data and past trip data (e.g., flight plans and schedules of other aircraft and/or airlines). For example, the vehicles can be aircraft and the determination of the relevant vehicle may exclude any aircraft that do not climb to flight levels, aircraft staying only on the same route for a short time, or aircraft only crossing the planned route at a relevant altitude.

At 415, the process 400 determines current and predicted positions of the relevant vehicles determined at 411. In implementations, the location information obtained at 405 for the relevant trips determined at 411 is analyzed to predict the trajectories and/or speed profiles of the other vehicles. For example, based on the information in the ADS-B messages and/or historical ADS-B recordings of a relevant aircraft (e.g., historical information 337), the process 400 (using, e.g., interference module 26) can predict of profile the position, altitude, and speed of the aircraft.

At 419, the process 400 compares current and predicted locations of the relevant vehicles determined at 415 with intended trajectory information of the first vehicle (e.g., intended trajectory information 338). At 423, the process 400 determines whether any interference exists based on the comparison made at 419. Additionally, in embodiments, the process determines with a likelihood of the interference (e.g., a percentage chance) and a time frame during which the interference may exist (e.g., 20-30 minutes, the next 15 minutes). If no interference exits, the process 400 iteratively restarts. However, if an interference is determined at 423 ("Yes"), then at 427, the process 400 determines one or more modifications to the intended trajectory (e.g., a maneuver) that resolves the interference with the at least one or more other vehicles. For example, an aircraft can determine that an early step climb to a planned flight level will avoid the interference, and determine an optimal time and rate for the step climb based on the current state of the aircraft, sensor data (e.g., current wind, temperature, air density), and the surrounding traffic.

At 431, the process 400 presents the modification determined at 427 to the operator of the first vehicle using a computer-user interface (e.g., I/O device 333). For example, the solutions can presented to a pilot of the vehicle on a CDU and/or an EICAS. At 435, the process 400 determines whether one of the solutions presented at 427 was accepted. If not ("No"), the process 400 iteratively restarts. However, if one of the solutions presented at 427 is accepted ("Yes"), then at 439 the process 400 modifies the intended trajectory of the first vehicle based on the solution. At 443, the process 400 executes the modification of the intended trajectory of the first vehicle.

Figure 5:
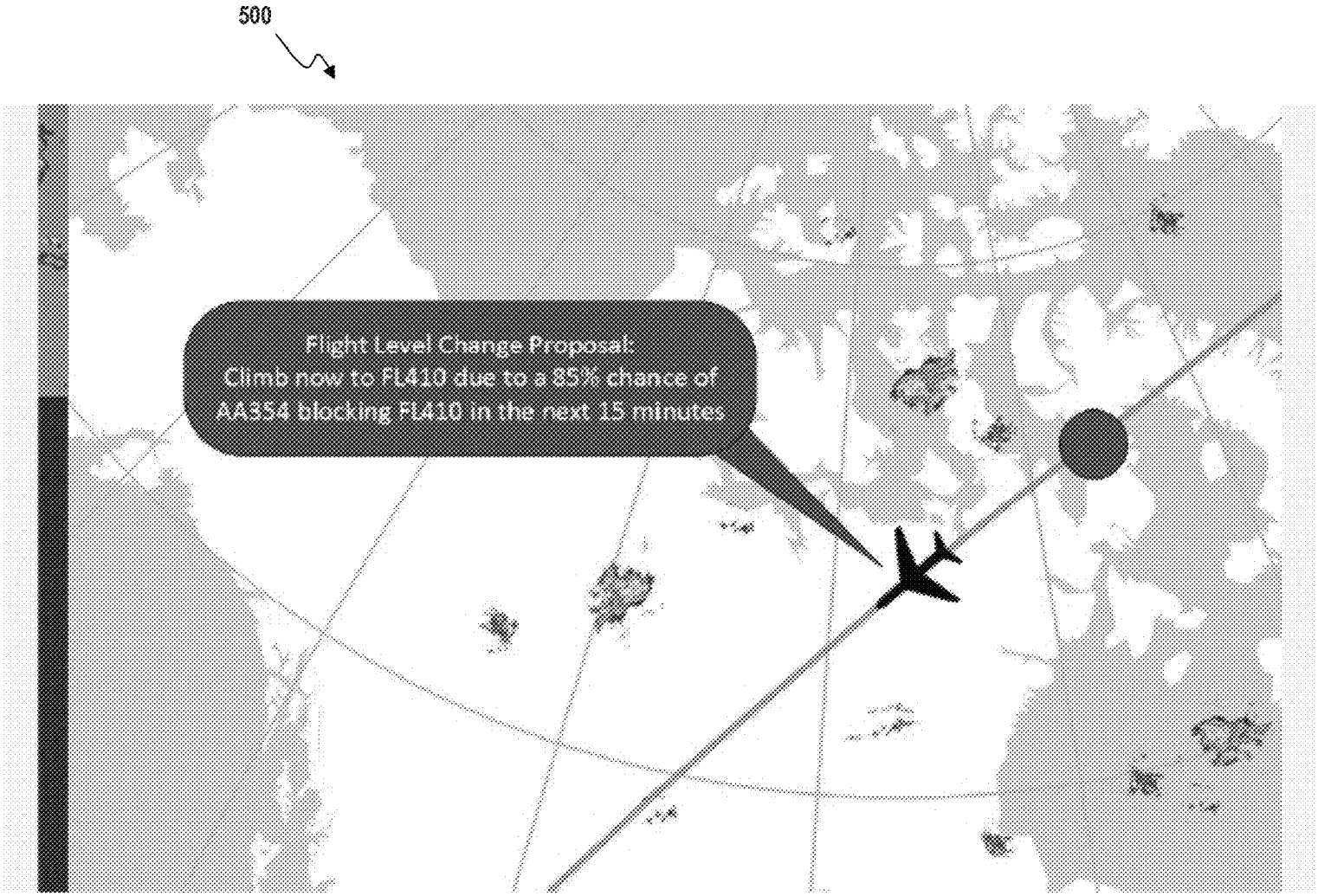
FIG. 5 illustrates an example of a computer-user interface in accordance an embodiment of the present disclosure.

FIG. 5 illustrates an example of a computer-user interface 500 presenting a predicted interference and a solution to the interference in accordance with aspects of the present disclosure (e.g., 431). In implementations, the computer-user interface 500 can be presented by a navigation system (e.g., vehicle processing system 22) using a display device (e.g. I/O device 333). For example, the display device can be a CDU and/or EICAS presenting an aircraft on a map from a birds-eye-view along with a message indicating a solution (e.g., 427) to avoid a particular aircraft, along with a likelihood of the interference and a time frame during the solution should be executed (e.g., FIG. 4, 443). The pilot of the aircraft can accept the proposed change using the CDU/EICAS, which can automatically request a change in flight plan with air traffic control (e.g., air traffic management facility 12) and update the flight profile for the aircraft to incorporate the solution.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." In addition, where features or aspects of the disclosure are described in terms of Markush groups, those skilled in the art will recognize that the disclosure is also thereby described in terms of any individual member or subgroup of members of the Markush group.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A processing system for a vehicle comprising:
a processor;
a display unit;
a computer-readable hardware storage device;
program instructions stored on the computer-readable hardware storage device for execution by the processor, the program instructions causing the processing system to perform operations comprising:
obtaining location information of a plurality of other vehicles and travel plans of the plurality of other vehicles;
comparing the location information of the plurality of other vehicles and the travel plans of the plurality of other vehicles with intended trajectory information of the vehicle, wherein the intended trajectory information of the vehicle includes a plurality of preplanned maneuvers of the vehicle through a plurality of predefined travel corridors;
determining that interference exists based on the comparing;
determining a modification to the intended trajectory information of the vehicle that resolves the interference with at least one of the plurality of other vehicles;
presenting, via the display unit, the modification to the intended trajectory information of the vehicle to an operator of the vehicle; and
modifying the intended trajectory information of the vehicle using the modification.

2. The processing system of claim 1, wherein:
the vehicle is an aircraft;
the intended trajectory information comprises a flight plan of the aircraft;
the plurality of other vehicles are other aircraft; and
the interference comprises one or more of the other aircraft obstructing the flight plan of the aircraft in a predefined travel corridor.

3. The processing system of claim 2, wherein the modification comprises a step climb.

4. The processing system of claim 2, wherein the location information comprises Automatic Dependent Surveillance-Broadcast (ADS-B) information.

5. The processing system of claim 2, wherein the location information comprises historical information recorded during previous flights by the other aircraft.

6. The processing system of claim 1, wherein the location information comprises intended trajectory information of the plurality of other vehicles.

7. The processing system of claim 1, wherein the operations further comprise determining one or more relevant vehicles among the plurality of other vehicles based on the location information and the intended trajectory information of the vehicle.

8. The processing system of claim 7, wherein the comparing the location information comprises:
determining predicted locations of the one or more relevant vehicles; and
comparing the predicted locations of the one or more relevant vehicles with the intended trajectory information of the vehicle.

9. The processing system of claim 8, wherein the determining that the interference exists comprises:
determining an interference between the vehicle and a first relevant vehicle of the one or more relevant vehicles based on the comparing the predicted locations of the one or more relevant vehicles with the intended trajectory information of the vehicle;
determining a probability of the interference between the vehicle and the first relevant vehicle; and
determining a time of the interference between the vehicle and the first relevant vehicle.

10. The processing system of claim 9, wherein the presenting the modification comprises displaying the modification, the probability of the interference, and the time of the interference.

11. A method for navigating a vehicle comprising:
receiving, by a communication system of the vehicle from a traffic information system, location information of a plurality of other vehicles and travel plans of the plurality of other vehicles; and
using a vehicle processing system to perform the steps of:
comparing the location information of the plurality of other vehicles and the travel plans of the plurality of other vehicles with intended trajectory information of the vehicle, wherein the intended trajectory information of the vehicle includes a plurality of preplanned maneuvers of the vehicle through a plurality of predefined travel corridors;
determining that interference exists based on the comparing;
determining a modification to the intended trajectory information of the vehicle that resolves the interference with one of the plurality of other vehicles;
presenting the modification to the intended trajectory information of the vehicle to an operator of the vehicle; and
modifying the intended trajectory information using the modification.

12. The method of claim 11, wherein:
the vehicle is an aircraft;
the intended trajectory information comprises a flight plan of the aircraft;
the plurality of other vehicles are other aircraft; and
the interference comprises one or more of the other aircraft blocking transit of the aircraft through a predefined travel corridor.

13. The method of claim 12, wherein the modification comprises a step climb.

14. The method of claim 12, wherein the location information comprises Automatic Dependent Surveillance-Broadcast (ADS-B) information.

15. The method of claim 12, wherein the location information comprises historical information recorded during previous flights by the other aircraft.

16. The method of claim 11, wherein the location information comprises intended trajectory information of the plurality of other vehicles.

17. The method of claim 11, further comprising determining one or more relevant vehicles among the plurality of other vehicles based on the location information and the intended trajectory information of the vehicle.

18. The method of claim 17, wherein the comparing the location information comprises:

determining predicted locations of the one or more relevant vehicles; and comparing the predicted locations of the one or more relevant vehicles with the intended trajectory information of the vehicle.

19. The method of claim 18, wherein the determining that the interference exists comprises:

determining an interference between the vehicle and a first relevant vehicle of the one more relevant vehicles based on the comparing the predicted locations of the one or more relevant vehicles with the intended trajectory information of the vehicle;

determining a probability of the interference between the vehicle and the first relevant vehicle; and determining a time of the interference between the vehicle and the first relevant vehicle.

20. A computer-program product comprising computer-readable program instructions stored on a computer-readable data storage device that, when executed by a processor, controls a computing device to perform operations comprising:

receiving location information of a plurality of other vehicles and travel plans of the plurality of other vehicles;

comparing the location information of the plurality of other vehicles and the travel plans of the plurality of other vehicles with intended trajectory information of a vehicle, wherein the intended trajectory information of the vehicle includes a plurality of preplanned maneuvers of the vehicle through a plurality of predefined travel corridors;

determining that interference exists based on the comparing;

determining a modification to the intended trajectory information of the vehicle that resolves the interference with one of the plurality of other vehicles;

presenting the modification to the intended trajectory information of the vehicle to an operator of the vehicle; and modifying the intended trajectory information using the modification.

21. The processing system of claim 1, wherein determining the interference comprises determining that the interference will delay the intended trajectory information of the vehicle.

22. The processing system of claim 1, wherein the interference does not include a physical collision between the vehicle and any of the plurality of other vehicles.

23. The processing system of claim 1, wherein determining the modification to the intended trajectory comprises modifying performance of one or more of the plurality of preplanned maneuvers of the vehicle to avoid the interference.

24. The processing system of claim 23, wherein modifying the performance of the one or more of the plurality of preplanned maneuvers of the vehicle to avoid the interference comprises determining a new time of performance of the preplanned maneuver that minimizes travel time of the vehicle or fuel use of the vehicle.

25. The processing system of claim 1, wherein:

a first maneuver of the plurality of preplanned maneuvers comprises maneuvering the vehicle from a first travel corridor of the plurality of the predefined travel corridors to a second travel corridor of the plurality of the predefined travel corridors at a predefined time or at a predefined location; and the modification to the intended trajectory comprises performing the first maneuver at a different time than the predefined time or at a different location than the predefined location.

* * * * *